US011873134B2

(12) United States Patent
Grigsby, III

(10) Patent No.: US 11,873,134 B2
(45) Date of Patent: Jan. 16, 2024

(54) KNOCK-DOWN CRATE FOR DURABLE GOODS

(71) Applicant: UFP Industries, Inc., Grand Rapids, MI (US)

(72) Inventor: John M. Grigsby, III, Woodstock, GA (US)

(73) Assignee: UFP Industries, Inc., Grand Rapids, MI (US)

( * ) Notice: Subject to any disclaimer, the term of this patent is extended or adjusted under 35 U.S.C. 154(b) by 0 days.

(21) Appl. No.: 18/026,024

(22) PCT Filed: Sep. 17, 2021

(86) PCT No.: PCT/US2021/050902

§ 371 (c)(1),
(2) Date: Mar. 13, 2023

(87) PCT Pub. No.: WO2022/061131

PCT Pub. Date: Mar. 24, 2022

(65) Prior Publication Data

US 2023/0365299 A1 Nov. 16, 2023

Related U.S. Application Data

(60) Provisional application No. 63/080,581, filed on Sep. 18, 2020.

(51) Int. Cl.
*B65D 19/38* (2006.01)
*B65D 85/68* (2006.01)

(52) U.S. Cl.
CPC ..... *B65D 19/385* (2013.01); *B65D 85/68* (2013.01); *B65D 2519/00024* (2013.01);
(Continued)

(58) Field of Classification Search
CPC ..... B65D 19/385; B65D 85/68; B65D 2519/00189; B65D 2519/00199;
(Continued)

(56) References Cited

U.S. PATENT DOCUMENTS 5,772,026 A 6/1998 Grigsby
6,585,126 B1 * 7/2003 Grigsby, Sr. ..... B65D 19/44 206/600

(Continued)

FOREIGN PATENT DOCUMENTS

DE 10051678 A1 5/2002
EP 3566975 A1 * 11/2019 ..... B65D 19/10

(Continued)

OTHER PUBLICATIONS

Patent Cooperation Treaty, International Search Report, PCT/US2021/050902 (dated Dec. 27, 2021).

(Continued)

*Primary Examiner* — Rafael A Ortiz
(74) *Attorney, Agent, or Firm* — Baker Donelson; Carl M. Davis, II

(57) ABSTRACT

A knock-down container readily assembled from a pallet, side support members, and a top frame pivotably changeable from a symmetric first configuration square for capping the container to a second collapsed configuration for component shipping, for containing durable goods for storage and shipping. The top frame has corner supports pivotally connected to a pair of opposing end members and connected to a pair of opposing side members, being movable from the first configuration for capping the knock-down container and the second configuration pivoted for collapsing the opposing side members together for shipping as a component.

34 Claims, 9 Drawing Sheets

(52) U.S. Cl.
CPC ..... *B65D 2519/00059* (2013.01); *B65D 2519/0097* (2013.01); *B65D 2519/00199* (2013.01); *B65D 2519/00233* (2013.01); *B65D 2519/00273* (2013.01); *B65D 2519/00293* (2013.01); *B65D 2519/00323* (2013.01); *B65D 2519/00338* (2013.01); *B65D 2519/00537* (2013.01); *B65D 2519/00542* (2013.01); *B65D 2519/00572* (2013.01); *B65D 2519/00676* (2013.01); *B65D 2519/00711* (2013.01); *B65D 2519/00815* (2013.01); *B65D 2585/6867* (2013.01)

(58) Field of Classification Search
CPC ..... B65D 2519/00273; B65D 2519/00293; B65D 2519/00298; B65D 2519/00323; B65D 2519/00537; B65D 2519/00542; B65D 2519/00572; B65D 2519/00676; B65D 2519/00711; B65D 2519/00815; B65D 2519/0097; B65D 2585/6867
USPC ..... 206/599, 600, 386
See application file for complete search history.

(56) References Cited

U.S. PATENT DOCUMENTS 6,938,557 B1 * 9/2005 Grigsby, Jr. ..... B65D 19/385 108/51.11
7,011,223 B1 * 3/2006 Grigsby, Sr. ..... B65D 19/385 108/56.1
7,097,054 B2 * 8/2006 Beck ..... B65D 19/12 206/509
7,350,662 B2 * 4/2008 Arnold ..... B65D 19/18 220/8
7,762,417 B2 * 7/2010 Arnold ..... B65D 85/68 220/4.03
8,083,448 B2 12/2011 Heinrichs et al.
2003/0150757 A1 * 8/2003 Dunn ..... B65D 19/12 206/335
2005/0000929 A1 * 1/2005 Dunn ..... B65D 19/385 211/17
2009/0120906 A1 5/2009 Grigsby
2012/0234213 A1 * 9/2012 Kiolbasa ..... B65D 19/385 108/53.5
2015/0158629 A1 * 6/2015 Harris ..... A47B 87/0215 108/51.11
2016/0325920 A1 11/2016 Belron
2016/0368702 A1 * 12/2016 O'Neil ..... B65D 85/68

FOREIGN PATENT DOCUMENTS

KR 20130002745 5/2013
WO 2013138870 A1 9/2013

OTHER PUBLICATIONS

Patent Cooperation Treaty, Written Opinion, PCT/US2021/050902 (dated Dec. 27, 2021).

* cited by examiner

KNOCK-DOWN CRATE FOR DURABLE GOODS

TECHNICAL FIELD

The present invention relates to crates and containers for storing and shipping large durable goods such as wheeled vehicles. More particularly, the present invention relates to crates assembled with components shipped separately for use by a durable goods manufacturer to contain, store and ship the durable goods.

BACKGROUND OF THE INVENTION

Large durable goods such as wheeled all-terrain vehicles (ATV) after manufacture are placed in shipping containers for storage and shipping from manufacturer's finished goods warehouse to retailers. The containers are typically supplied to the durable goods manufacturer by a container manufacturer, which incurs shipping costs as well as container cost. Because the containers shipped from the container manufacturer to the durable goods manufacturer are empty of the durable goods, the containers preferably are manufactured as components for shipping the components separately. The components typically are a base or pallet, a top frame, and side posts that extend between the pallet and the top frame when assembled for containing the durable goods. The components typically stack for storage and shipping, such as a stack of pallets, and generally a greater number of containers can be shipped in a truck for example as components than as assemble containers.

There is a need however to further increase the shipping density yet provide readily assembled components for manufacturers of durable goods to assemble for containing, storing and shipping durable goods for reducing container supplier shipping costs to container-user manufacturers. It is to such that the present invention is directed.

SUMMARY OF THE INVENTION

The present invention meets the need in the art by providing a knock-down container for durable goods containment readily assembled from components, comprising a pallet for supporting a durable good, a plurality of vertical posts, each for extending in a first direction from the pallet to a distal extent; and a top frame for capping the knock-down container by seating on the distal extents of the plurality of vertical posts. The top frame comprises a plurality of corner supports for seating on the distal extents of the plurality of vertical posts. A pair of opposing end members pivotally connect at opposing ends to two opposing ones of the plurality of the corner supports. A pair of opposing side members connect at opposing ends to a respective one of the corner supports of a first and a second one of the pair of opposing end members. A transverse support member pivotally connected at a first end to one of the pair of the opposing side members and movable to an extended position for connecting to other of the pair of the opposing side members with the top frame. The top frame movable from a first configuration squared for seating on the distal extents of the plurality of vertical posts for capping the knock-down container with the transverse support member extended for connecting to the other of the pair of the opposing side members with the top frame in the first configuration and a second configuration pivoted for collapsing the opposing side members together for shipping as a component.

In another aspect, the present invention provides a knock-down container for durable goods containment, comprising a pallet for supporting a durable good, the pallet comprising a pair of supports disposed spaced-apart and interconnected by a plurality of transverse members extending between opposing interior sides of the pair of supports and a pair of opposing end assemblies. Each support comprise a pair of opposing elongated runners disposed in spaced-apart relation, a plurality of transverse braces spaced-apart and connected at respective distal ends to the opposing elongated runners, and a pair of legs spaced-apart and connected at respective distal ends to the opposing elongated runners with a distal extent outwardly of the elongated runners for contacting a support surface. Each of the end assemblies comprising a pair of opposing stacking receivers open in a first direction, a pair of opposing corner receivers each attached to a respective stacking receiver and extending in a second direction opposing the first direction, a first transverse member connected at distal ends to the opposing corner receivers, whereby for each support a first of the opposing elongated runners attaches to the respective corner receiver and a second of the opposing elongated runners attaches to the first transverse member. Each of the ends of the second of the pair of runners defines an opening. A fastener extends through the respective openings in the first transverse member and the second of the runners. A second transverse member vertically spaced from the first transverse member and connected at distal ends to the opposing stacking receivers, and a plurality of connectors each attached to a respective corner receivers for connecting to the distal end of the respective first of the opposing elongated runners. A plurality of vertical posts, each for extending in a first direction from the pallet to a distal extent and a top frame for capping the knock-down container by seating on the distal extents of the plurality of vertical posts. The top frame comprising a plurality of corner supports for seating on the distal extents of the plurality of vertical posts, a pair of opposing end members, each end member pivotally connected at opposing ends to two opposing ones of the plurality of the corner supports; and a pair of opposing side members, each side member connected at opposing ends to a respective one of the corner supports of a first and a second one of the pair of opposing end members. The top frame movable from a first configuration squared for seating on the distal extents of the plurality of vertical posts for capping the knock-down container and a second configuration pivoted for collapsing the opposing side members together for shipping as a component.

In yet another aspect, the present invention provides a knock-down container for durable goods containment, comprising a pallet for supporting a durable good, the pallet comprising a pair of supports disposed spaced-apart and interconnected by a plurality of transverse members extending between opposing interior sides of the pair of supports. Each support comprises a pair of opposing elongated runners disposed in spaced-apart relation, a plurality of transverse braces spaced-apart and connected at respective distal ends to the opposing elongated runners; and a pair of legs spaced-apart and connected at respective distal ends to the opposing elongated runners with a distal extent outwardly of the elongated runners for contacting a support surface. A first of the opposing elongated runners attaches to the respective corner receiver and a second of the opposing elongated runners attaches to the first transverse member. The pallet further comprises a pair of opposing end assemblies each comprising a pair of opposing stacking receivers open in a first direction, a pair of opposing corner receivers, each attached to a respective stacking receiver and extending in a second direction opposing the first direction, a first transverse member connected at distal ends to the opposing corner receivers, a second transverse member vertically spaced from the first transverse member and connected at distal ends to the opposing stacking receivers, and a plurality of connectors each attached to a respective corner receivers for connecting to the distal end of the respective first of the opposing elongated runners, whereby the pair of supports connect to a respective corner receiver and the first transverse member. The knock-down container further comprises a plurality of vertical posts, each for extending in a first direction from the pallet to a distal extent and a top frame for capping the knock-down container by seating on the distal extents of the plurality of vertical posts. The top frame comprising a plurality of corner supports for seating on the distal extents of the plurality of vertical posts; a pair of opposing end members, each end member pivotally connected at opposing ends to two opposing ones of the plurality of the corner supports; and a pair of opposing side members, each side member connected at opposing ends to a respective one of the corner supports of a first and a second one of the pair of opposing end members. The top frame movable from a first configuration squared for seating on the distal extents of the plurality of vertical posts for capping the knock-down container and a second configuration pivoted for collapsing the opposing side members together for shipping as a component.

In another aspect, the present invention provides a knock-down container for durable goods, comprising a pallet for supporting a durable good, the pallet having a pair of end assemblies interconnected by a pair of outside runners and a pair of inner runners. Each of the end assemblies comprising a pair of opposing U-shaped stacking receivers and a pair of opposing corner receivers, each attached to a respective stacking receiver and extending in the first direction. A first transverse member connects at distal ends to the opposing corner receivers and a second transverse member vertically spaced from the first transverse member connects at distal ends to the opposing stacking receivers. The pair of outside runners connect to a respective corner receiver and the pair of inner runners connect to the first transverse member. A plurality of vertical posts, each for extending from a respective one of the corner receivers in a first direction to a distal extent. A top frame for capping the knock-down container by seating on the distal extents of the plurality of vertical posts. The top frame comprises a plurality of corner supports for seating on the distal extents of the plurality of vertical posts. A pair of opposing end members, each end member pivotally connects at opposing ends to two opposing ones of the plurality of the corner supports. A pair of opposing side members, each side member connects at opposing ends to a respective one of the corner supports of a first and a second one of the pair of opposing end members. The top frame being movable from a first configuration squared for seating on the distal extents of the plurality of vertical posts for capping the knock-down container and a second configuration pivoted for collapsing the opposing side members together for shipping as a component.

Objects, advantages, and features of the present invention will become readily apparent upon a reading of the following detailed description in conjunction with the drawings.

DETAILED DESCRIPTION

Figure 1:
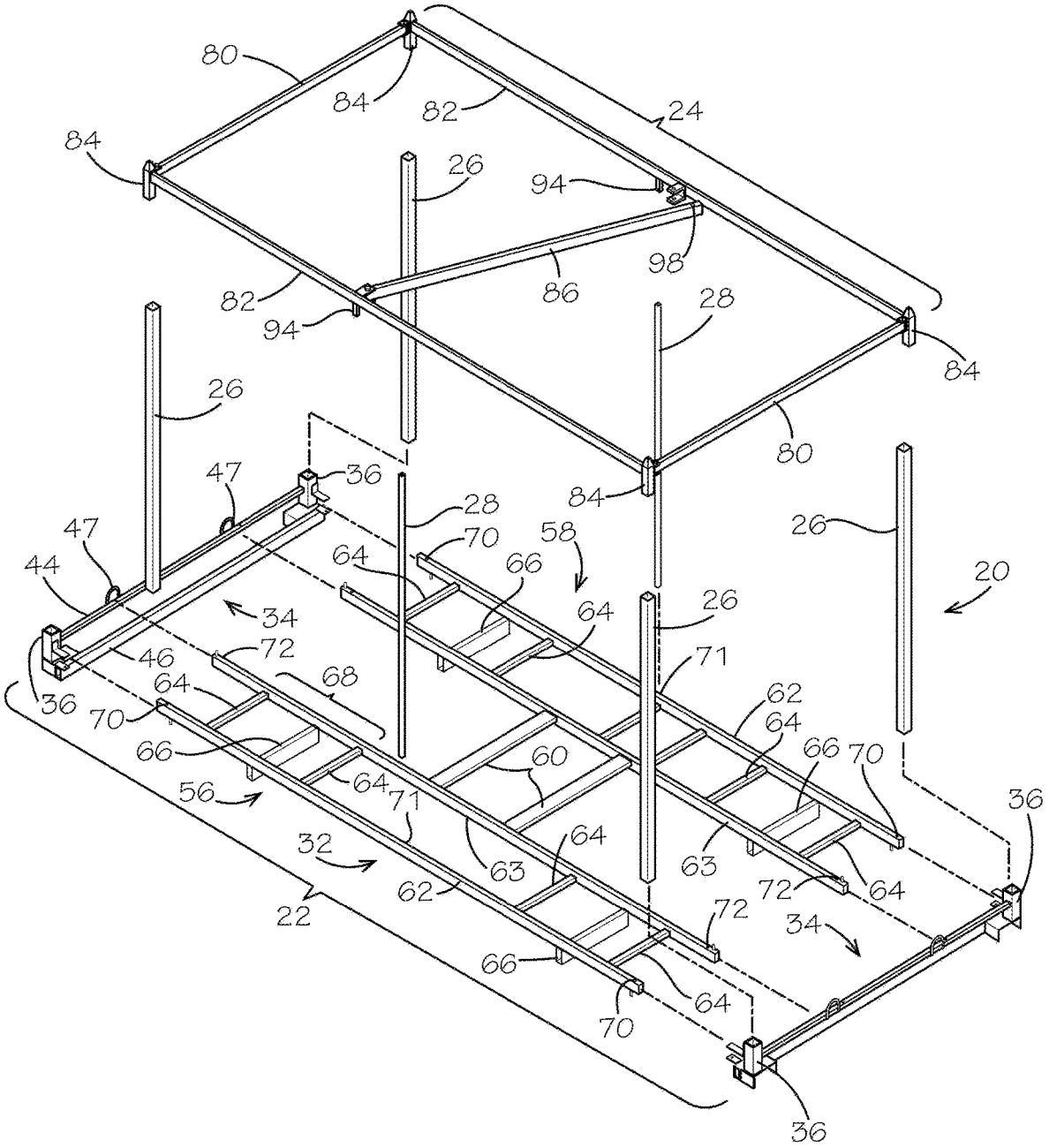
FIG. 1 illustrates a perspective exploded view of a knock-down container with separate pallet, side supports, and top frame components in accordance with the present invention.

With reference to the drawings in which like parts have like identifiers, FIG. 1 illustrates a perspective exploded view of a knock-down container 20 in accordance with the present invention. The container 20 assembles with a base or pallet 22 for supporting a durable good, for example but not limited to an ATV (not shown) and an opposing top frame 24 that caps the container as supported by a plurality of corner verticals or posts 26. For purposes of discussion, the following will refer to a container for an ATV, which container has a first configuration of separate components and a second configuration assembled for storage and shipping of durable good products, for example, lawn and garden tractors, personal watercraft, washer and dryer equipment (individual or combined top and bottom assemblies, and other large durable goods. The illustrated embodiment optionally includes side supports 28 intermediate opposing ends of the container. The container 20 assembles from these separate knock-down components that readily ship from a container manufacturer as a supplier to a user manufacturer of ATV wheeled vehicles for assembly as a crate for storing and shipping its durable goods to retailers or end customers.

Figure 2:
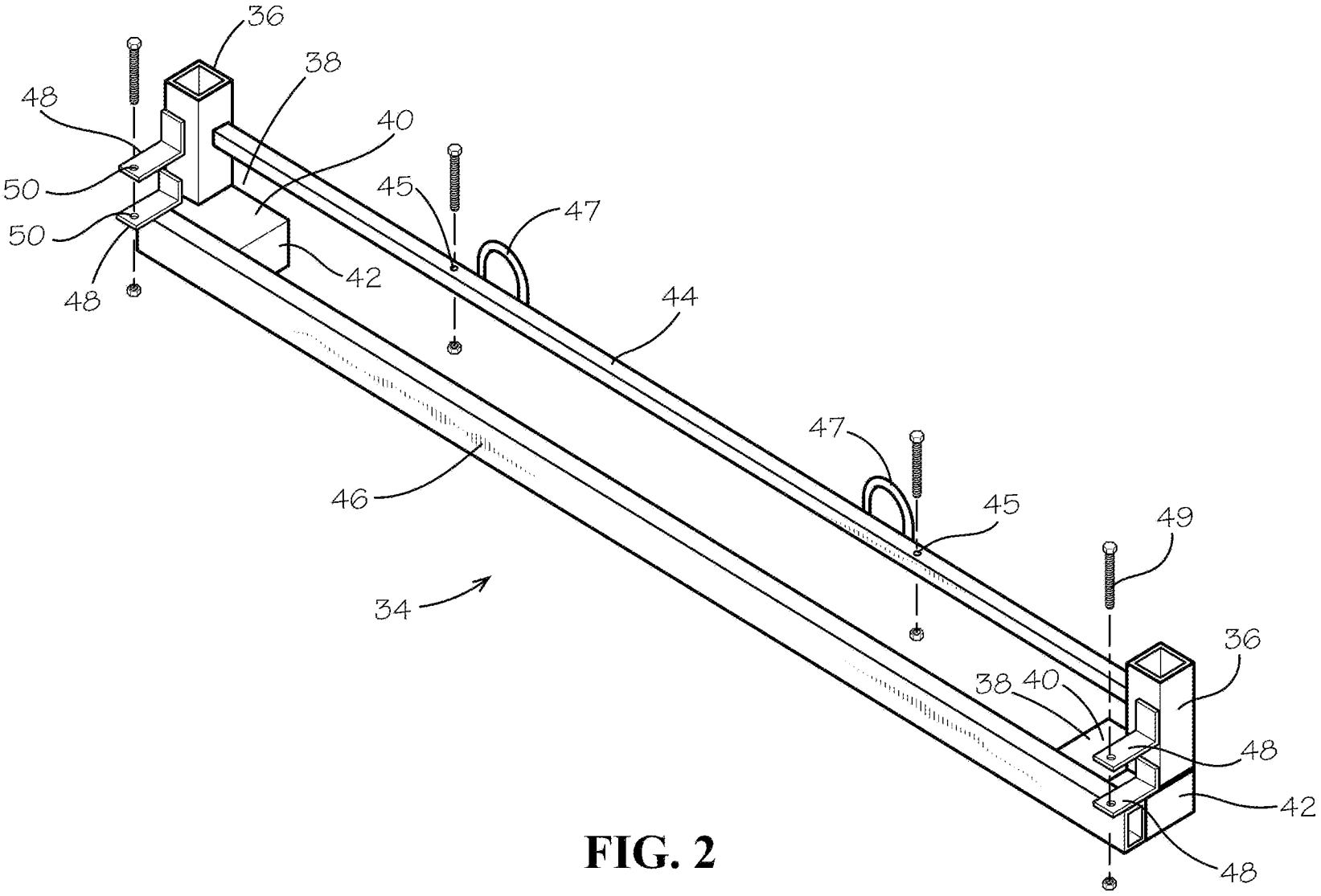
FIG. 2 illustrates a perspective view of a pallet end assembly.

The base 22 includes a pallet base 32 and a pair of opposing end assemblies 34. The pallet base 32 connects to the end assemblies 34 as discussed below. With reference to FIG. 2, the end assembly 34, illustrated in perspective view, has opposing corner receivers 36 each attached to a respective opposing stacking target 38. The corner receivers 36 are open-end tubular members. The stacking target 38 is a support member, that in the illustrated embodiment, has a U-shape with a base 40 and opposing leg plates 42 with free distal ends. The corner receiver 36 attaches to an upper surface of the base of the stacking target 38 disposed with an open side facing downwardly. An elongate upper member 44 extends transverse to a longitudinal axis of the pallet 22 between and rigidly attaches to the opposing corner receivers 36. The upper member 44 defines a pair of spaced openings 45. One or more loops 47 may attach to the upper member 44 for engaging straps for securing the container 20 together after assembly and holding an ATV. A lower member 46 extends transverse to a longitudinal axis of the pallet 22 between and rigidly attaches at opposing distal ends to inward sides of the opposing stacking targets 38. The first member 44 is vertically spaced from the second member 46. A pair of flanges 48 attach to and extend from an inward face of the corner receiver 36 in spaced relation. Each flange 48 defines an opening 50 for receiving a fastener 49 such as a bolt or pin. In the illustrated embodiment, each flange 48 is an L-shaped member. In an alternate embodiment, the flanges 48 may be defined by a U-shaped member attached to the corner receivers 36 with projecting legs. The flanges 48 are spaced-apart vertically to define a gap 51.

The corner receivers 36 receive a bottom end of the corner verticals or posts 26. The corner posts 26 extend from the pallet to a distal extent. The top frame 24 seats on the distal extents of the corner posts 26.

With continuing reference to FIG. 1, the pallet base 32 comprises a pair of spaced-part elongated supports 56, 58 interconnected by transverse intermediate connector members 60 (with FIG. 1 showing two connector members 66 in spaced relation). The supports 56, 58 each include two space-apart longitudinal runners 62, 63 interconnected by a plurality of transverse braces 64 and a pair of legs 66 also disposed transverse to the runners. The supports 56, 8 each define a pair of wheel wells 68 for receiving a wheel of the wheeled ATV. Two of the braces 64 and a respective intermediate leg 66 are spaced relative to each other to define the gap 68 as the wheel well. The legs 66 extend below a bottom edge of the runners 62, 63 with a distal end for seating contact of the pallet base 32 on a support surface such as a floor of a warehouse or a truckbed. The opposing distal ends of the runners 62 each define an opening 70 for receiving a fastener 49 (see FIG. 2) for engaging the end to a respective one of the corner receivers 36. The gap 51 between the opposing flanges 48 receives the end of the runner 62. An opening 71 in the runner 63 intermediate, preferably medial, the opposing ends receives an end of one of the side supports 28 for the container 20 during assembly and use. The gap 52 defined by the opposing angle members 48 receives a respective end of the runner 62, and the fastener 49 extends through the aligned openings 70 and 50 to secure the end of the runner to the end assembly 34. The opposing distal ends of the runners 63 each define an opening 72. The opening 72 aligns with the opening 45 of the upper member 44 for receiving a fastener to secure the runner 62 to the end assemblies 34.

In the illustrated embodiment, the intermediate connector members 60 rigidly connect to the opposing faces of the runners 63. In an alternate embodiment, the intermediate connector members 60 are detachably engaged with fasteners to the runners 63, whereby the separate supports 56, 58 may be separately stacked for shipping and assembly on-site at an ATV manufacturing facility.

Figure 3:
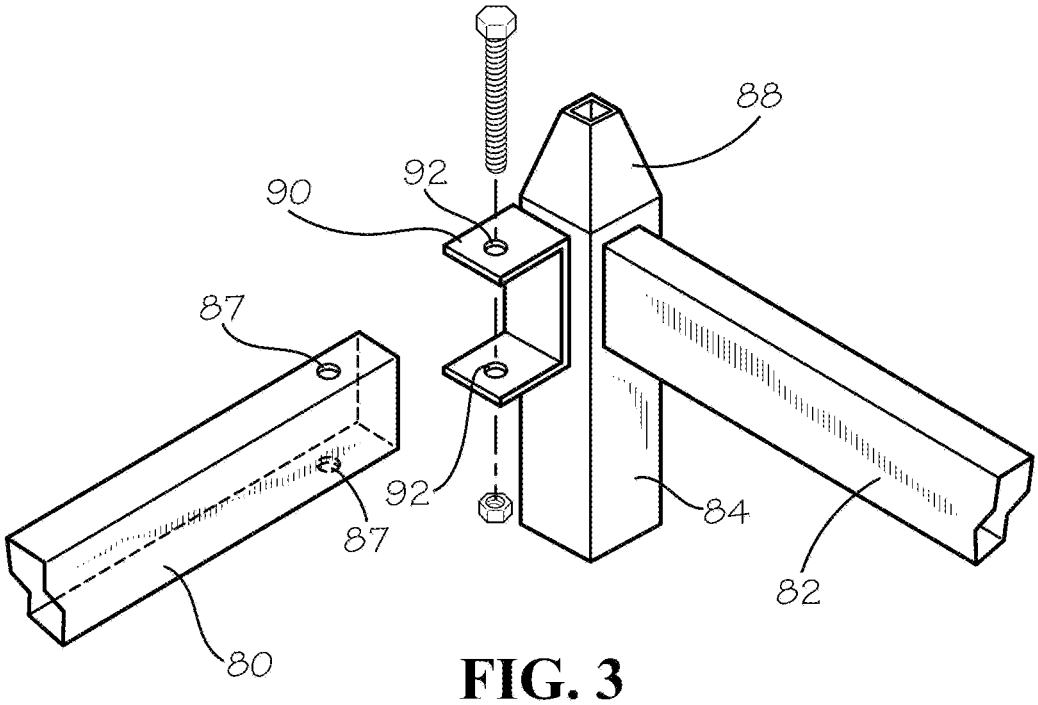
FIG. 3 illustrates a detailed exploded view of an end portion of the top frame illustrated in FIG. 1.

The top frame 24 assembles with opposing end members 80 and opposing side members 82 connected to top frame corner members 84 and a diagonal transverse member 86. FIG. 3 illustrates a detailed view of an end portion of the top frame with one of the corner members 84 of the top frame 24 with the end member 80 exploded away. The opposing distal ends of the end member 80 each define an opening 87. The corner members 84 are open-ended tubes with a tapered end 88 having a narrower cross-section than a lower portion. The tapered end 88 may be formed by crushing the end of the tube. The tapered ends 88 define extended stacking members for being received in the open end of the stacking target 38. A U-shaped member 90 (or opposing angle members) attach to an inner face of the corner member 84. The flange legs of the member 90 define openings 92 for receiving a fastener 93 that extends through the opening 92 and aligned opening 87 in a respective end of the side member 82. In the illustrated embodiment, the side members 82 rigidly connect to the corner member 84. A pair of tubular members 94 attach to the opposing sides 82 intermediate, preferably medial, opposing ends of the side member. The tubular members 94 align with the openings 71 in the rails 62 for receiving one of the side supports 28 therebetween.

The top frame 24 seats on the distal extents of the corner posts 26. The open bottom end of the corner members 84 in the top frame receive a distal end of a respective one of the corner posts 26, as illustrated in FIGS. 1 and 7.

Figure 4:
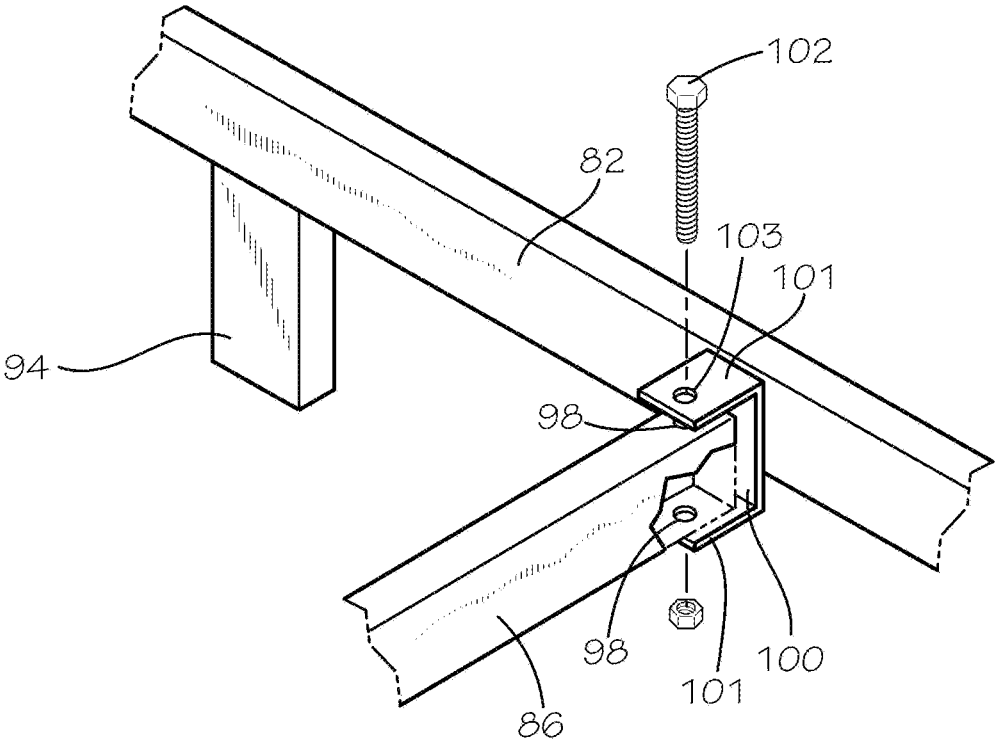
FIG. 4 illustrates a second detailed view of an intermediate portion of the top frame illustrated in FIG. 1.

With reference to FIG. 4 illustrating a second detailed view of an intermediate portion of the top frame 24, the diagonal transverse member 86 defines an opening 98 in each opposing distal end for detachably attaching to the opposing side members 82. A U-shaped member 100 having opposing leg plates 101 attaches to the inner face of each side member 82. The leg plates 101 each define an opening 103 for receiving the fastener 102. The U-shaped member 100 receives a respective end of the transverse member 86, and the fastener 102 extends through the aligned openings to detachably secure the transverse member 86 to the side member 82.

Figure 5:
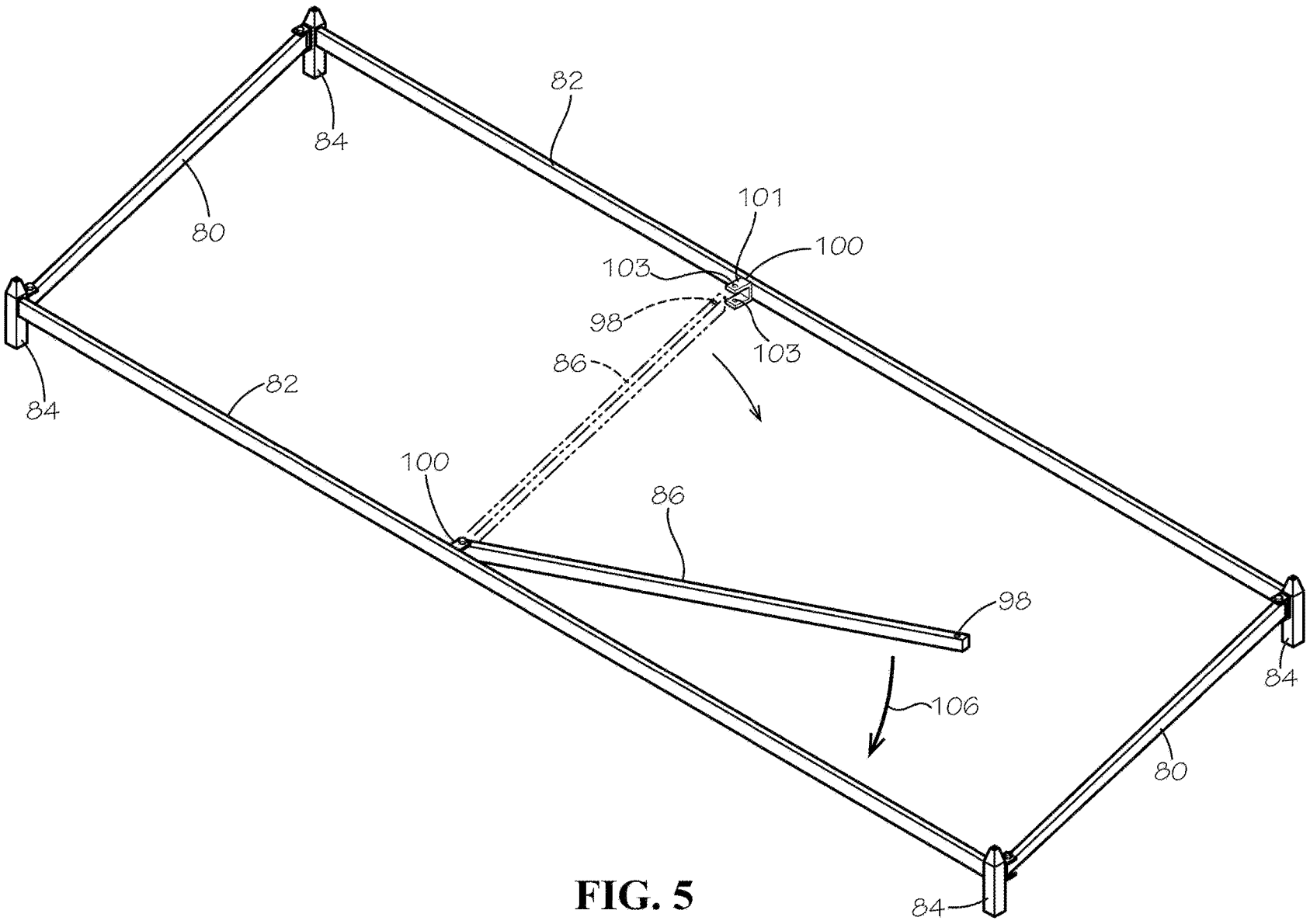
FIG. 5 illustrates the top frame during knock-down from a first configuration for use with closing or capping the knock-down container illustrated in FIG. 1 for use to a second configuration for shipping as a component of the knock-down container.
Figure 6:
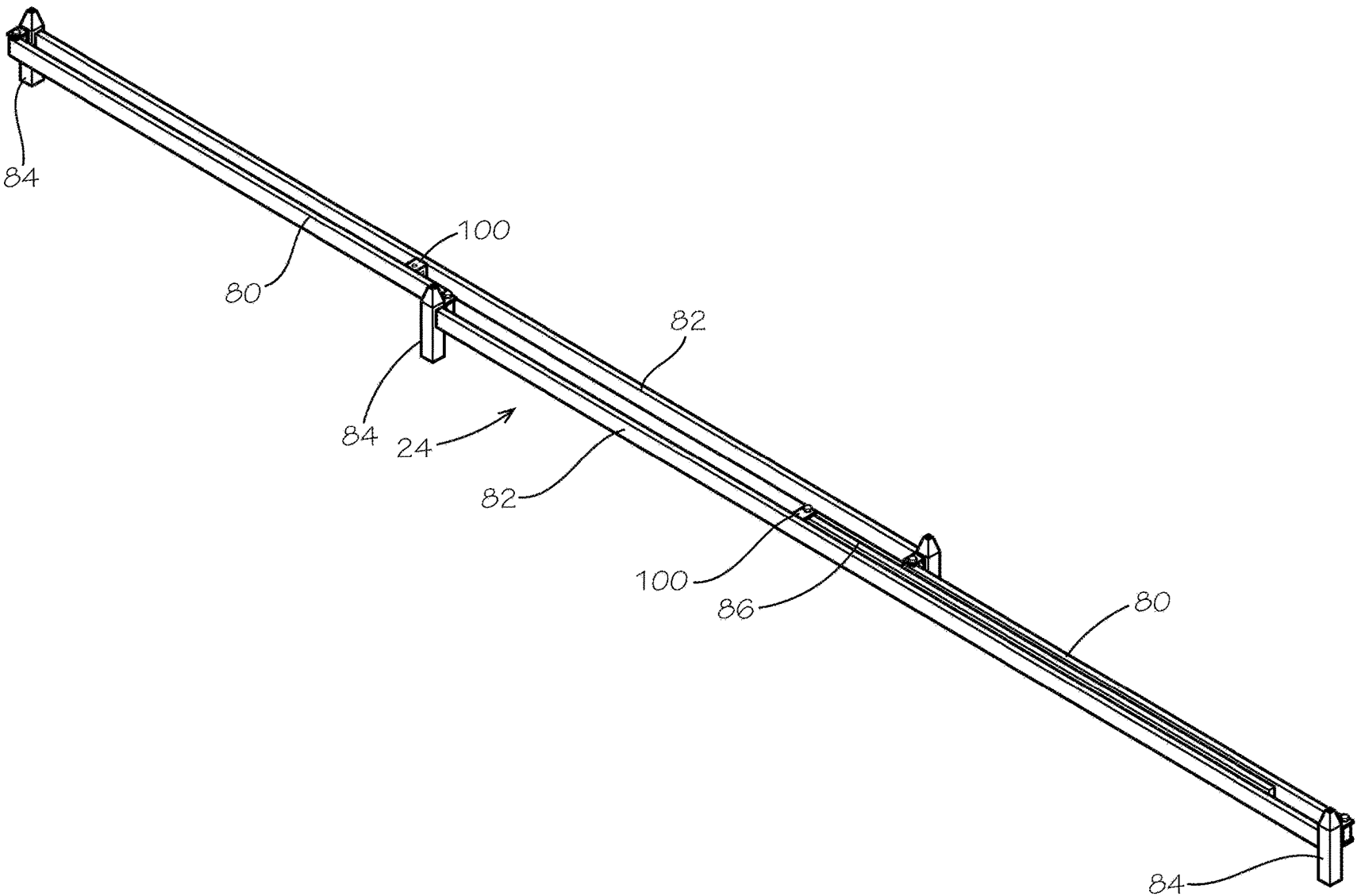
FIG. 6 illustrates the top frame in the second configuration knocked-down or pivotedly collapsed together for shipping as a component of the knock-down container illustrated in FIG. 1.

FIG. 5 illustrates the top frame 24 during knock-down from the first configuration for use with closing or capping the knock-down container 20 as illustrated in FIG. 1 to a slimmed knock-down configuration for shipping as a component of the knock-down container. The diagonal member 86 detaches from connection to the connector 100 on one of the sides 82 and pivots towards the opposing side member as indicated by the arrow 106. Also, the end members 80 pinned to the corner members 84 allow the top frame 24 to skew or change its relative spacing orientation from the symmetrical squared first configuration, and move the opposing sides together to the second, or component knock-down shipping, configuration. As shown in FIG. 6 illustrating the top frame in the second configuration knocked-down or pivoted collapsed together for shipping as a component of the knock-down container illustrated in FIG. 1, the opposing end members 80 pivot on the pinned connections and allow the opposing side members 82 to move together to the illustrated knocked-down second configuration for shipping as a component. The top frame 24 thus has the first configuration oriented squared apart open as shown in FIG. 1 for capping the container 20 by seating on the distal ends of the corner members 26 and the second configuration changed by pivoting on the pinned end members to a knock-down collapsed orientation for storage and shipping as a component assembly.

Figure 7:
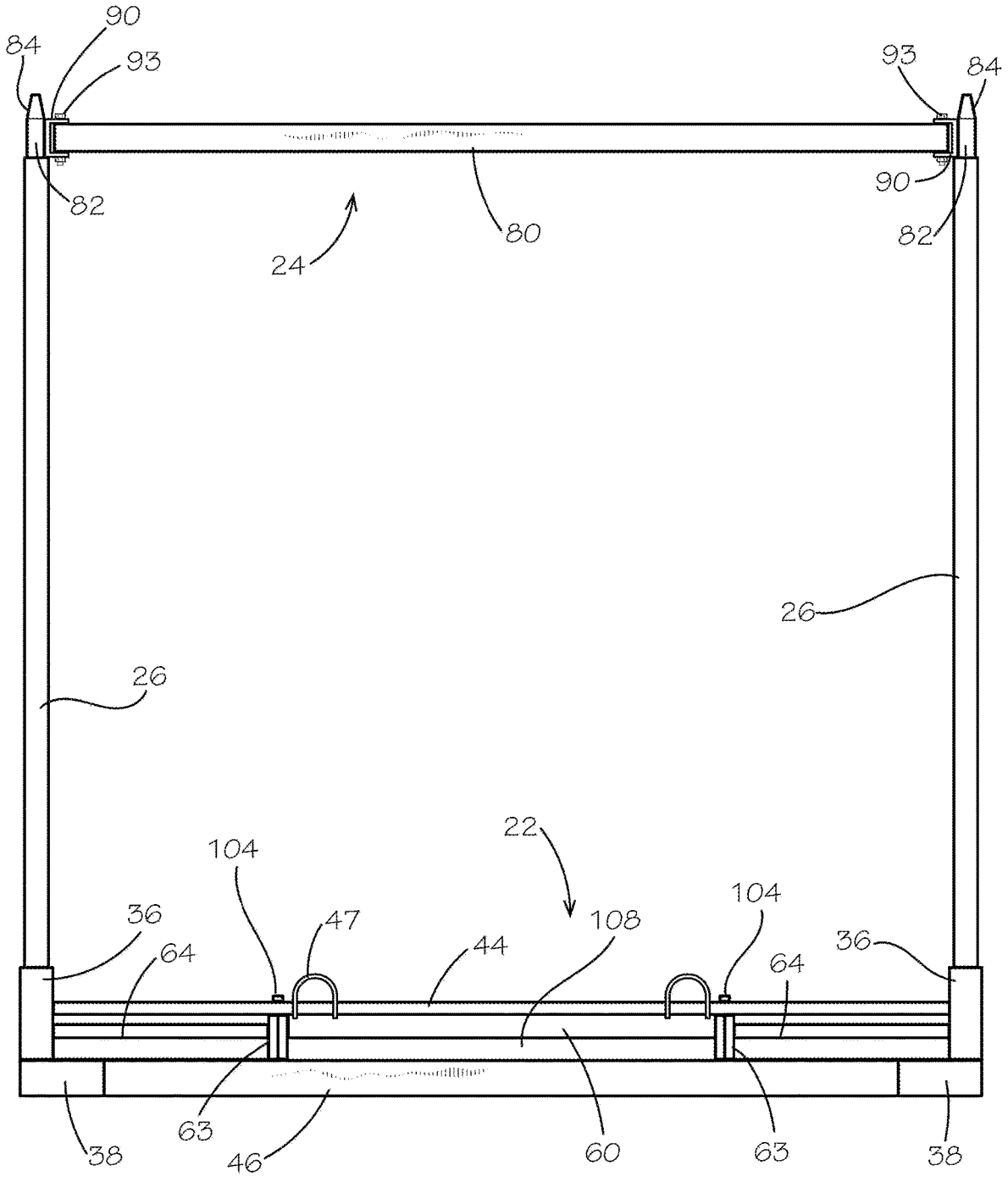
FIG. 7 illustrates an end view of the assembled knock-down container illustrated in FIG. 1.

FIG. 7 illustrates an end view of the assembled knock-down container 20 illustrated in FIG. 1. The open end of the tubular corner receivers 36 receive an end of a respective one of corner posts 26. Fasteners 104 extend through aligned openings 45, 71 in the runners 63 and the upper member 44 to secure the runners 63 to the end assembly 34. A gap 108 defines an opening for passing of forks of a forklift truck for handling the container 20.

Figure 8:
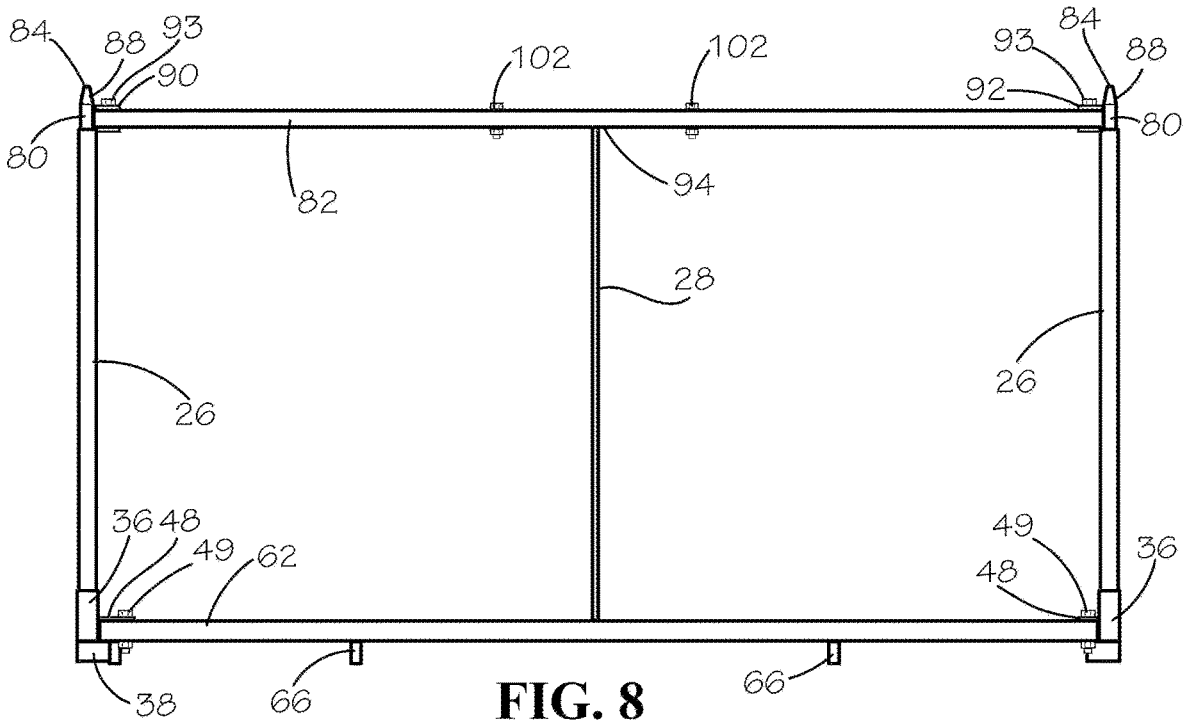
FIG. 8 illustrates a side view of the assembled knock-down container illustrated in FIG. 1.

FIG. 8 illustrates a side view of the assembled knock-down container illustrated in FIG. 1. Respective ends of the side support 28 insert into the opening 71 in the runner 62 and the receiver tube 94 in the vertically aligned side 82 of the top frame 24.

Figure 9:
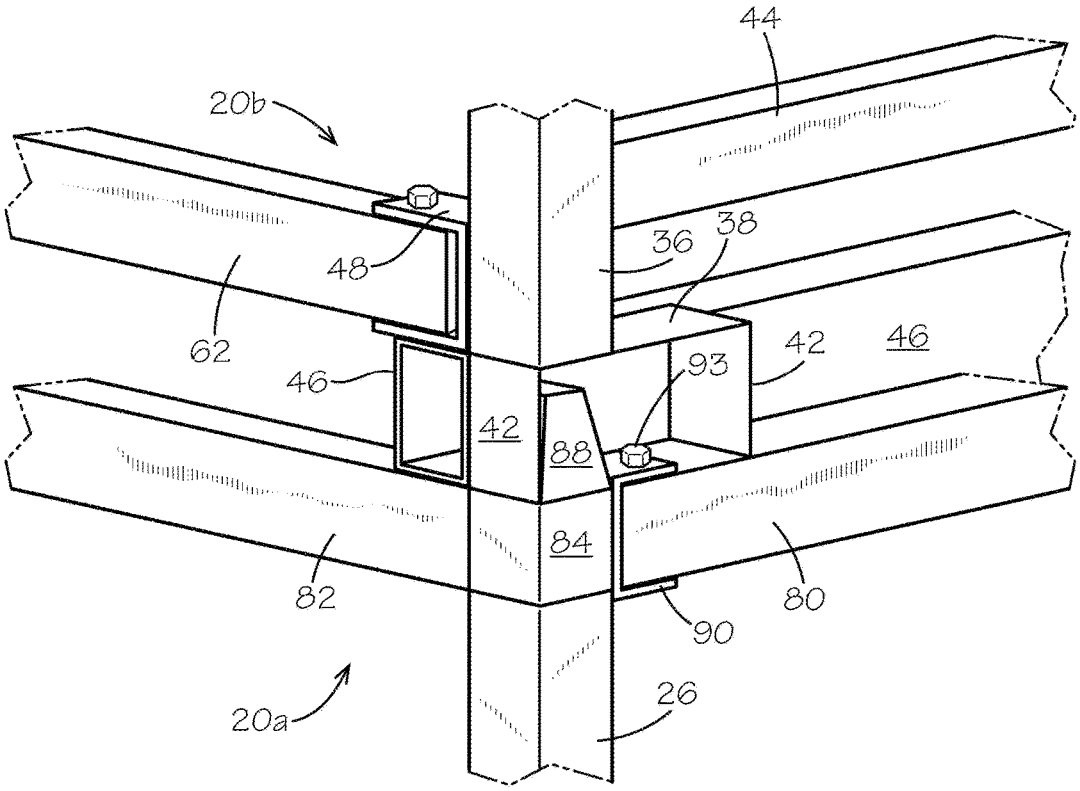
FIG. 9 illustrates a detail view of a first knock-down container with a second knock-down container placed on top for a stack of knock-down containers.

FIG. 9 illustrates a detail view of a first container 20*a* with a second knock-down container 20*b* placed on top for a stack of knock-down containers. The open end of the corner receiver 36 of the upper container 20*b* seats on the tapered end 88 of the top frame corner member 84 of the lower container 20*a*.

Figure 10:
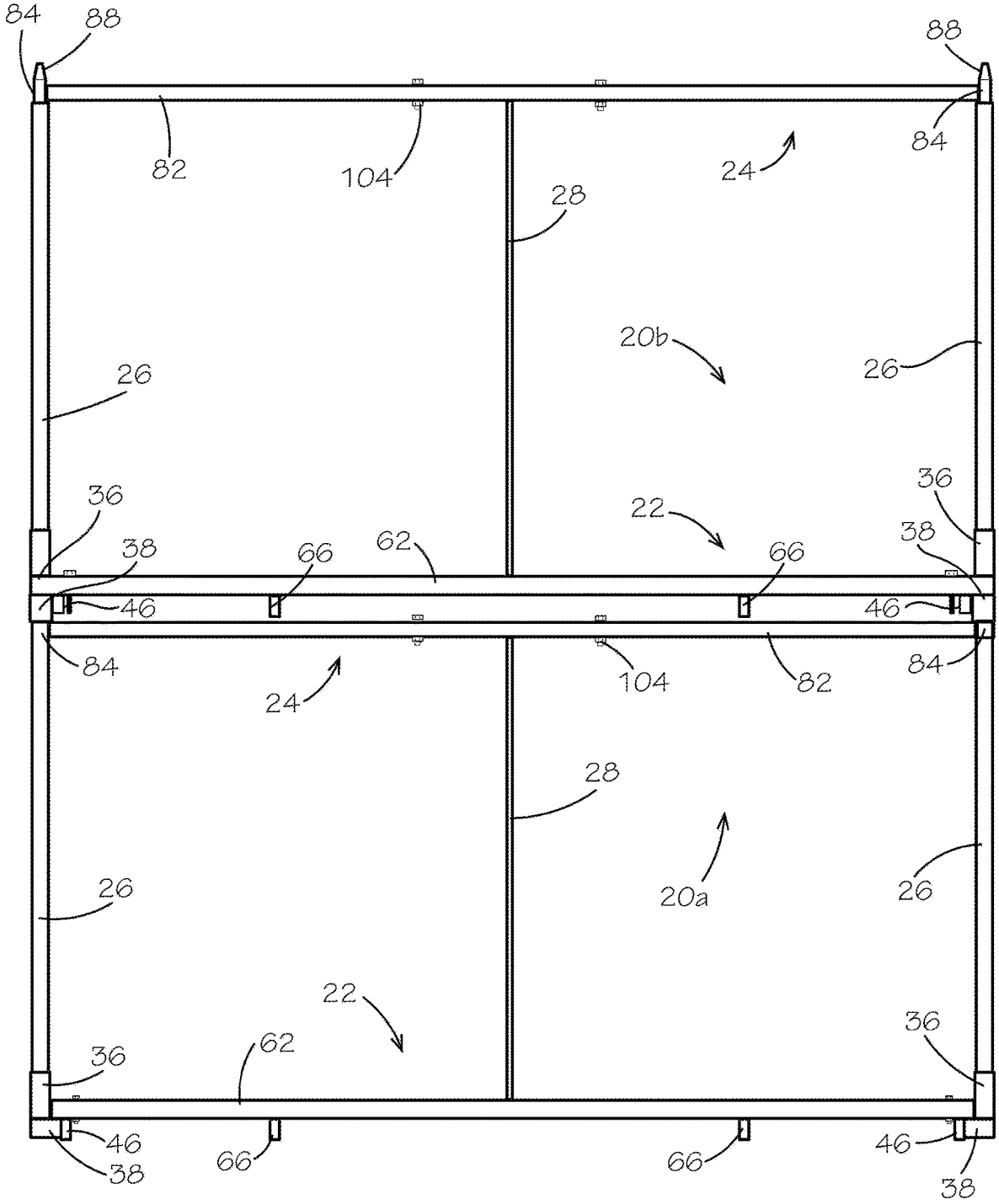
FIG. 10 illustrates a side view of two of the knock-down containers in a stack for storage or shipping.

FIG. 10 illustrates a side view of two of the knock-down containers 20*a*, 20*b* in a stack for storage or shipping.

The components of the disclosed container 20 readily stack with like components for component density shipping advantages and features resulting in reduced shipping costs of the crating or container from a manufacturer to the goods manufacture using the components in an assembled knock-down container for durable goods containers, and thus achieve reduced costs to ATV and durable goods manufacturers for containing and shipping their products. The base 22 readily assembles from pairs of the pallet end assemblies 34 that attach with pins or fasteners through aligned openings in the angle members 48 and ends of the runners 62 and aligned openings in the upper transverse member and the end of the runners 63. A plurality of the pallet bases 32 stack one on another in offset relation whereby the legs 66 of one pallet base 32 abuts the legs 66 on a lower pallet base in the stack. The top frame 24 readily transforms from the knock-down configuration shown in FIG. 6 by moving on the pinned connections of the end members 80 relative to the corner members 84, opening to a squared use configuration illustrated in FIG. 1. As shown in FIG. 5, the top diagonal support 86 pivots on the pinned connection to connect to the opposing connector 100. The top frame 24 readily collapses after use for the container configuration as shown in FIG. 1 upon detachment of end of the diagonal support member 86 from one of the sides 82, allowing the top frame 24 to shew and pivot on the pinned ends of the end members 80, to the shipping component configuration as shown in FIG. 6.

The members in the structure of the container components are elongated steel tubes.

Figure 11:
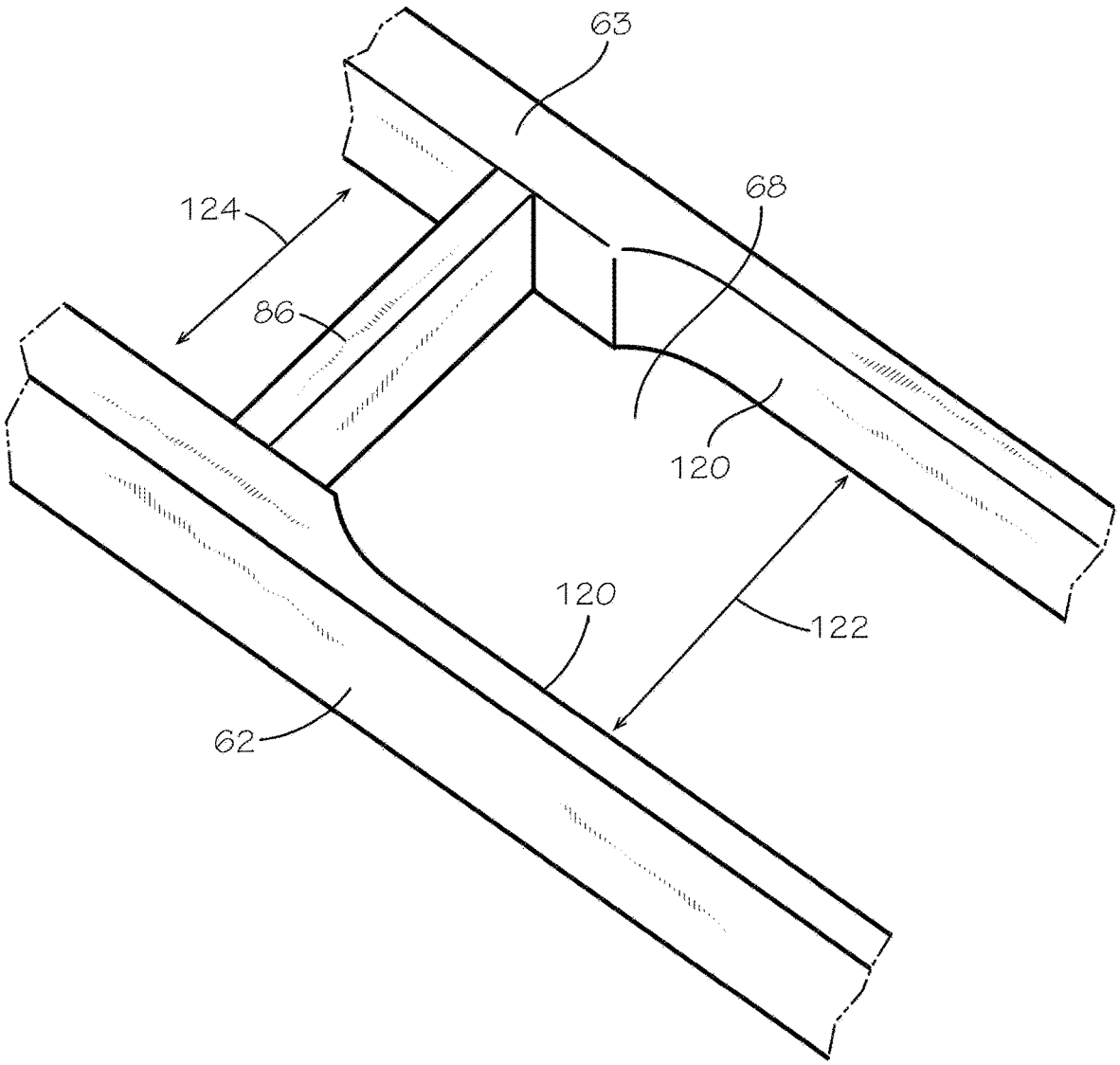
FIG. 11 illustrates an alternate embodiment of the pallet component for the knock-down container to accommodate wheels of a larger width without changing the overall width of the pallet.

FIG. 11 illustrates an alternate embodiment that accommodates wheels of a larger width without changing the overall width of the pallet 22. In this embodiment, a portion generally 120 of the elongated members 62, 63 between the spaced transverse braces 66 in the wheel well gap 68 may be crushed to provide additional width 122 relative to the spacing 124 of the runners 62, 63, for accommodating larger tires without changing the overall width of the base.

The foregoing discloses a knock-down container readily assembled from pallet, side support members, and skewable top frame changeable from the symmetric first configuration square for capping the container to the second collapsed configuration for component shipping, for containing durable goods for storage and shipping. While this invention has been described in detail with particular reference to an illustrated embodiment thereof providing a knock-down container configured readily from components for durable goods containing for storage and shipping, it should be understood that many modifications or changes, in addition to those expressly recited, may be made thereto without departure from the scope of the invention as set forth in the appended claims.

What is claimed is:

1. A knock-down container for durable goods containment, comprising:

a pallet for supporting a durable good;

a plurality of vertical posts, each for extending in a first direction from the pallet to a distal extent; and a top frame for capping the knock-down container by seating on the distal extents of the plurality of vertical posts, said top frame comprising:

a plurality of corner supports for seating on the distal extents of the plurality of vertical posts;

a pair of opposing end members, each end member pivotally connected at opposing ends to two opposing ones of the plurality of the corner supports;

a pair of opposing side members, each side member connected at opposing ends to a respective one of the corner supports of a first and a second one of the pair of opposing end members, whereby the top frame movable from a first configuration squared for seating on the distal extents of the plurality of vertical posts for capping the knock-down container and a second configuration pivoted for collapsing the opposing side members together for shipping as a component; and a transverse support member pivotally connected at a first end to one of the pair of the opposing side members and movable to an extended position for connecting to other of the pair of the opposing side members with the top frame in the first configuration.

2. The knock-down container as recited in claim 1, wherein the pallet comprises:

a pair of supports disposed spaced-apart and interconnected by a plurality of transverse members extending between opposing interior sides of the pair of supports; and a pair of opposing end assemblies.

3. The knock-down container as recited in claim 2, wherein each support comprises:

a pair of opposing elongated runners disposed in spaced-apart relation;

a plurality of transverse braces spaced-apart and connected at respective distal ends to the opposing elongated runners; and a pair of legs spaced-apart and connected at respective distal ends to the opposing elongated runners with a distal extent outwardly of the elongated runners for contacting a support surface.

4. The knock-down container as recited in claim 3, wherein two of the transverse braces and one of the legs are spaced for defining a wheel well for receiving a wheel of a durable good placed on the pallet.

5. The knock-down container as recited in claim 2, wherein each of the end assemblies further comprises a stacking target open in a second direction opposing the first direction for receiving one of a plurality of stacking members extending from the top frame.

6. The knock-down container as recited in claim 5, wherein the stacking members each comprise a tapered portion extending from a respective one of the corner supports in the first direction to a distal extent remote from an outer surface of the side member.

7. The knock-down container as recited in claim 2, wherein each end assembly comprises:

a pair of opposing stacking receivers open in a second direction opposing the first direction;

a pair of opposing corner receivers, each attached to a respective stacking receiver and extending in the first direction;

a first transverse member connected at distal ends to the opposing corner receivers;

a second transverse member vertically spaced from the first transverse member and connected at distal ends to the opposing stacking receivers, whereby the pair of supports connect to a respective corner receiver and the first transverse member.

8. The knock-down container as recited in claim 7, wherein each support comprises:

a pair of opposing elongated runners disposed in spaced-apart relation;

a plurality of transverse braces spaced-apart and connected at respective distal ends to the opposing elongated runners; and a pair of legs spaced-apart and connected at respective distal ends to the opposing elongated runners with a distal extent outwardly of the elongated runners for contacting a support surface whereby a first of the opposing elongated runners attaches to the respective corner receiver and a second of the opposing elongated runners attaches to the first transverse member.

9. The knock-down container as recited in claim 8, further comprising a plurality of connectors each attached to a respective corner receivers for connecting to the distal end of the respective first of the opposing elongated runners.

10. The knock-down container as recited in claim 9, wherein the connector comprises a pair of opposing spaced-apart flanges to define a gap for receiving the end of the respective first of the opposing elongated runners; and further comprising a fastener to secure the end to the flanges.

11. The knock-down container as recited in claim 10, wherein the flanges each define an opening; and wherein the end of the respective first of the opposing elongated runners defines an opening, whereby the fastener extends through the aligned openings in the opposing flanges and end of the respective first of the opposing elongated runners.

12. The knock-down container as recited in claim 8, wherein the first transverse member defines a pair of spaced-apart openings; and the ends of the second of the pair of runners defines an opening; and further comprising a fastener for extending through a respective one of the openings in the transverse member and a respective opening in the end of the second of the pair of runners.

13. The knock-down container as recited in claim 2, wherein each end assembly further comprises at least one strap loop for receiving an elongated strap for securing the durable good to the pallet.

14. The knock-down container as recited in claim 7, wherein each end assembly further comprises at least one strap loop for receiving an elongated strap for securing the durable good to the pallet.

15. The knock-down container as recited in claim 14, wherein the at least one strap look attaches to the first transverse member.

16. A knock-down container for durable goods, comprising:

a pallet for supporting a durable good, the pallet having a pair of end assemblies interconnected by a pair of outside runners and a pair of inner runners;

each of the end assemblies comprising:

a pair of opposing U-shaped stacking receivers;

a pair of opposing corner receivers, each attached to a respective stacking receiver and extending in the first direction;

a first transverse member connected at distal ends to the opposing corner receivers;

a second transverse member vertically spaced from the first transverse member and connected at distal ends to the opposing stacking receivers, whereby the pair of outside runners connect to a respective corner receiver and the pair of inner runners connect to the first transverse member;

a plurality of vertical posts, each for extending from a respective one of the corner receivers in a first direction to a distal extent; and a top frame for capping the knock-down container by seating on the distal extents of the plurality of vertical posts, said top frame comprising:

a plurality of corner supports for seating on the distal extents of the plurality of vertical posts;

a pair of opposing end members, each end member pivotally connected at opposing ends to two opposing ones of the plurality of the corner supports; and a pair of opposing side members, each side member connected at opposing ends to a respective one of the corner supports of a first and a second one of the pair of opposing end members, whereby the top frame movable from a first configuration squared for seating on the distal extents of the plurality of vertical posts for capping the knock-down container and a second configuration pivoted for collapsing the opposing side members together for shipping as a component.

17. The knock-down container as recited in claim 16, further comprising a transverse member pivotally connected at a first end to one of the pair of the opposing side members and movable to an extended position for connecting to other of the pair of the opposing side members with the top frame in the first configuration.

18. The knock-down container as recited in claim 17, further comprising:

a plurality of transverse braces disposed in spaced-apart relation and each attached between a respective one of the outer runners and adjacent inner runner; and at least two pairs of legs, each pair attached in spaced-apart relation to a respective one of the outer runners and adjacent inner runner, with a distal extent outwardly of the runners for contacting a support surface.

19. A knock-down container for durable goods containment, comprising:

a pallet for supporting a durable good comprising:

a pair of supports disposed spaced-apart and interconnected by a plurality of transverse members extending between opposing interior sides of the pair of supports, wherein each support comprises:

a pair of opposing elongated runners disposed in spaced-apart relation;

a plurality of transverse braces spaced-apart and connected at respective distal ends to the opposing elongated runners; and a pair of legs spaced-apart and connected at respective distal ends to the opposing elongated runners with a distal extent outwardly of the elongated runners for contacting a support surface;

a pair of opposing end assemblies each comprising:

a pair of opposing stacking receivers open in a first direction;

a pair of opposing corner receivers, each attached to a respective stacking receiver and extending in a second direction opposing the first direction;

a first transverse member connected at distal ends to the opposing corner receivers and defining a pair of spaced-apart openings, whereby for each support a first of the opposing elongated runners attaches to a respective corner receiver and a second of the opposing elongated runners attaches to a respective first transverse member, the ends of the second of the pair of runners each define an opening;

a respective fastener of a plurality of fasteners for extending through a respective one of the openings in the first transverse member and a respective opening in the end of the second of the pair of runners for attaching together; and a second transverse member vertically spaced from the first transverse member and connected at distal ends to the opposing stacking receivers; and a plurality of vertical posts, each for extending in a first direction from the pallet to a distal extent; and a top frame for capping the knock-down container by seating on the distal extents of the plurality of vertical posts, said top frame comprising:

a plurality of corner supports for seating on the distal extents of the plurality of vertical posts;

a pair of opposing end members, each end member pivotally connected at opposing ends to two opposing ones of the plurality of the corner supports; and a pair of opposing side members, each side member connected at opposing ends to a respective one of the corner supports of a first and a second one of the pair of opposing end members, whereby the top frame movable from a first configuration squared for seating on the distal extents of the plurality of vertical posts for capping the knock-down container and a second configuration pivoted for collapsing the opposing side members together for shipping as a component.

20. The knock-down container as recited in claim 19, further comprising a transverse support member pivotally connected at a first end to one of the pair of the opposing side members and movable to an extended position for connecting to other of the pair of the opposing side members with the top frame in the first configuration.

21. The knock-down container as recited in claim 19, wherein two of the transverse braces and one of the legs are spaced for defining a wheel well for receiving a wheel of a durable good placed on the pallet.

22. The knock-down container as recited in claim 19, wherein each of the end assemblies further comprises a stacking target open in a second direction opposing the first direction for receiving one of a plurality of stacking members extending from the top frame.

23. The knock-down container as recited in claim 22, wherein the stacking members each comprise a tapered portion extending from a respective one of the corner supports in the first direction to a distal extent remote from an outer surface of the side member.

24. The knock-down container as recited in claim 19, further comprising a plurality of connectors each attached to a respective corner receivers for connecting to the distal end of the respective first of the opposing elongated runners.

25. The knock-down container as recited in claim 24, wherein the connector comprises a pair of opposing spaced-apart flanges to define a gap for receiving the end of the respective first of the opposing elongated runners; and further comprising a fastener to secure the end to the flanges.

26. The knock-down container as recited in claim 25, wherein the flanges each define an opening; and wherein the end of the respective first of the opposing elongated runners defines an opening, whereby the fastener extends through the aligned openings in the opposing flanges and end of the respective first of the opposing elongated runners.

27. The knock-down container as recited in claim 19, wherein each end assembly further comprises at least one strap loop for receiving an elongated strap for securing the durable good to the pallet.

28. The knock-down container as recited in claim 27, wherein the at least one strap look attaches to the first transverse member.

29. A knock-down container for durable goods containment, comprising:

a pallet for supporting a durable good comprising:

a pair of supports disposed spaced-apart and interconnected by a plurality of transverse members extending between opposing interior sides of the pair of supports, wherein each support comprises:

a pair of opposing elongated runners disposed in spaced-apart relation;

a plurality of transverse braces spaced-apart and connected at respective distal ends to the opposing elongated runners; and a pair of legs spaced-apart and connected at respective distal ends to the opposing elongated runners with a distal extent outwardly of the elongated runners for contacting a support surface;

a pair of opposing end assemblies each comprising:

a pair of opposing stacking receivers open in a second direction opposing the first direction;

a pair of opposing corner receivers, each attached to a respective stacking receiver and extending in the first direction;

a first transverse member connected at distal ends to the opposing corner receivers, whereby for each support a first of the opposing elongated runners attaches to the corner receivers and a second of the opposing elongated runners attaches to the first transverse members;

a plurality of connectors each attached to a respective corner receiver for connecting to the distal end of the respective first of the opposing elongated runners; and a second transverse member vertically spaced from the first transverse member and connected at distal ends to the opposing stacking receivers;

a plurality of vertical posts, each for extending in a first direction from the pallet to a distal extent; and a top frame for capping the knock-down container by seating on the distal extents of the plurality of vertical posts, said top frame comprising:

a plurality of corner supports for seating on the distal extents of the plurality of vertical posts;

a pair of opposing end members, each end member pivotally connected at opposing ends to two opposing ones of the plurality of the corner supports; and a pair of opposing side members, each side member connected at opposing ends to a respective one of the corner supports of a first and a second one of the pair of opposing end members, whereby the top frame movable from a first configuration squared for seating on the distal extents of the plurality of vertical posts for capping the knock-down container and a second configuration pivoted for collapsing the opposing side members together for shipping as a component.

30. The knock-down container as recited in claim 29, further comprising a transverse support member pivotally connected at a first end to one of the pair of the opposing side members and movable to an extended position for connecting to other of the pair of the opposing side members with the top frame in the first configuration.

31. The knock-down container as recited in claim 29, wherein two of the transverse braces and one of the legs are spaced for defining a wheel well for receiving a wheel of a durable good placed on the pallet.

32. The knock-down container as recited in claim 29, wherein each of the end assemblies further comprises a stacking target open in a second direction opposing the first direction for receiving one of a plurality of stacking members extending from the top frame.

33. The knock-down container as recited in claim 29, wherein the connector comprises a pair of opposing spaced-apart flanges to define a gap for receiving the end of the respective first of the opposing elongated runners; and further comprising a fastener to secure the end to the flanges.

34. The knock-down container as recited in claim 33, wherein the flanges each define an opening; and wherein the end of the respective first of the opposing elongated runners defines an opening, whereby the fastener extends through the aligned openings in the opposing flanges and end of the respective first of the opposing elongated runners.

* * * * *